US011377324B2

(12) United States Patent
Kim

(10) Patent No.: US 11,377,324 B2
(45) Date of Patent: Jul. 5, 2022

(54) JUMP ELEVATOR AND JUMPING METHOD

(71) Applicant: Otis Elevator Company, Farmington, CT (US)

(72) Inventor: Jongryeol Kim, Shanghai (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 189 days.

(21) Appl. No.: 16/546,873

(22) Filed: Aug. 21, 2019

(65) Prior Publication Data

US 2020/0062549 A1 Feb. 27, 2020

(30) Foreign Application Priority Data

Aug. 21, 2018 (CN) ..... 201810954999.1

(51) Int. Cl.

*B66B 11/00* (2006.01)
*B66B 19/00* (2006.01)
*B66B 9/00* (2006.01)

(52) U.S. Cl.

CPC ..... *B66B 11/0045* (2013.01); *B66B 9/00* (2013.01); *B66B 11/002* (2013.01); *B66B 19/007* (2013.01)

(58) Field of Classification Search

CPC .... B66B 19/007; B66B 19/002; B66B 19/005
See application file for complete search history.

(56) References Cited

U.S. PATENT DOCUMENTS

| | | | |
|---|---|---|---|
| 5,065,843 | A | 11/1991 | Richards |
| 7,261,184 | B2 | 8/2007 | Bass et al. |
| 7,559,409 | B2 | 7/2009 | Barneman et al. |
| 7,562,744 | B2 | 7/2009 | Mustalahti et al. |
| 8,141,684 | B2 | 3/2012 | Bjoerni et al. |
| 9,174,822 | B2 | 11/2015 | Cortona et al. |
| 9,388,020 | B2 | 7/2016 | Peacock et al. |
| 2008/0308362 | A1 | 12/2008 | Tucker |
| 2010/0163347 | A1 | 7/2010 | Van Der Meijden et al. |
| 2017/0166419 | A1 | 6/2017 | Rasanen et al. |

FOREIGN PATENT DOCUMENTS

| | | | |
|---|---|---|---|
| CN | 101535165 | A | 9/2009 |
| CN | 201999604 | U | 10/2011 |
| CN | 103723603 | A | 4/2014 |
| CN | 204625031 | U | 9/2015 |

(Continued)

OTHER PUBLICATIONS

Machine Translation of WO 2018/099761.*

(Continued)

*Primary Examiner* — Diem M Tran
(74) *Attorney, Agent, or Firm* — Cantor Colburn LLP

(57) ABSTRACT

A jump elevator includes a machine room provided in the hoistway and configured to be fixed or movable relative to the hoistway; at least one lifting assembly comprising: a frame attached to the outside of the hoistway and partially extending into the hoistway; a pulley assembly including a winch, a fixed end, and a plurality of pulleys disposed on the machine room and the frame; wherein a pulling line is disposed between the winch, the plurality of pulleys, and the fixed end; wherein the at least one lifting assembly is disposed below the covering portion of the hoistway.

18 Claims, 4 Drawing Sheets

(56) References Cited

FOREIGN PATENT DOCUMENTS

| | | | | | |
|---|---|---|---|---|---|
| CN | 105019866 | A | | 11/2015 | |
| CN | 204802823 | U | | 11/2015 | |
| CN | 207608190 | U | | 7/2018 | |
| DE | 102019205164 | A1 | * | 10/2020 | B66B 9/187 |
| EP | 1591406 | B2 | | 11/2005 | |
| EP | 2636629 | A1 | | 9/2013 | |
| FR | 2694279 | A1 | * | 2/1994 | B66B 19/00 |
| JP | H09278325 | A | | 10/1997 | |
| JP | 2002332175 | A | * | 11/2002 | B66B 19/002 |
| JP | 3844944 | B2 | | 11/2006 | |
| WO | 0050328 | A2 | | 8/2000 | |
| WO | 0164572 | A1 | | 9/2001 | |
| WO | WO-2005000729 | A1 | * | 1/2005 | B66B 11/008 |
| WO | 2010100319 | A1 | | 9/2010 | |
| WO | WO-2017102684 | A1 | * | 6/2017 | B66B 7/024 |
| WO | WO-2018099761 | A1 | * | 6/2018 | B66B 9/187 |
| WO | WO-2020126904 | A2 | * | 6/2020 | B66B 19/00 |
| WO | WO-2020126906 | A1 | * | 6/2020 | B66B 19/00 |

OTHER PUBLICATIONS

European Search Report EP 19192938.9, dated Feb. 3, 2020, 66 pages.

Chinese Office Action for Application No. 201810954999.1; dated Oct. 28, 2021; 9 Pages.

* cited by examiner

JUMP ELEVATOR AND JUMPING METHOD

FOREIGN PRIORITY

This application claims priority to Chinese Patent Application No. 201810954999.1, filed Aug. 21, 2018, and all the benefits accruing therefrom under 35 U.S.C. § 119, the contents of which in its entirety are herein incorporated by reference.

TECHNICAL FIELD

The present application relates to the field of elevator construction and operation, and more particularly to a jump elevator that enables the lifting of an elevator machine room during construction of the building. The application also relates to a jumping method for a jump elevator.

BACKGROUND TECHNIQUE

It is known that jump elevators (jumplift) are often used in the construction of multi-story buildings. The machine room of the elevator should be gradually elevated as the number of building construction increases.

However, the lifting structure of the existing jump elevator is relatively complicated and needs to be operated by a relatively complicated jumping method. Such a jump elevator and jumping method result in relatively high operating costs and time consumption.

Accordingly, it would be desirable to provide an improved jump elevator and jumping method solution that is capable of avoiding or ameliorating the above problems, at least to some extent.

SUMMARY

One object of the present application to provide a jump elevator that is capable of reducing operating costs and time consumption while achieving rapid lifting. Another object of the present application is to provide a jumping method.

An embodiment includes a jump elevator including a machine room provided in the hoistway and configured to be fixed or movable relative to the hoistway; at least one lifting assembly comprising: a frame attached to the outside of the hoistway and partially extending into the hoistway; a pulley assembly including a winch, a fixed end, and a plurality of pulleys disposed on the machine room and the frame; wherein a pulling line is disposed between the winch, the plurality of pulleys, and the fixed end; wherein the at least one lifting assembly is disposed below the covering portion of the hoistway.

The jump elevator and the jumping method of the present application have the advantages of simple structure, easy manufacture, convenient installation and reliable implementation, and can improve the operating efficiency of the jump elevator and the construction efficiency of the building.

DRAWING DESCRIPTION

The present application will be further described in details below with reference to the accompanying drawings and preferred embodiments, but those skilled in the art will understand that the drawings are only for the purpose of explaining the preferred embodiments, and therefore should not be restrictions on the scope of application. In addition, the drawings are only intended to be illustrative of the composition or construction of the described objects and may include exaggerated representations, and the drawings are not necessarily to scale.

DETAILED DESCRIPTION

Figure 1:
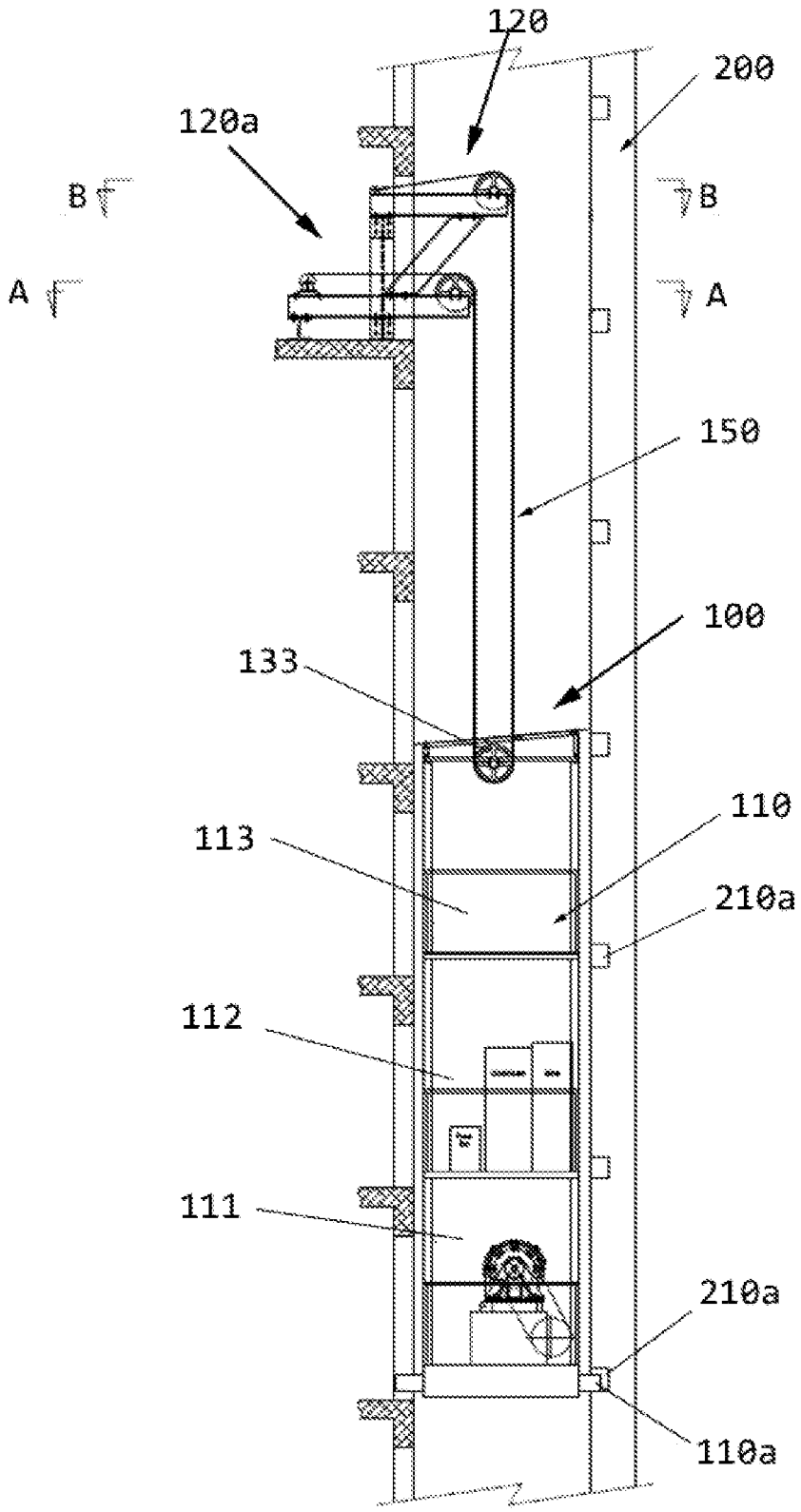
FIG. 1 is a perspective view of one embodiment of a jump elevator of the present application.

Preferred embodiments of the present application will be described in detail below with reference to the accompanying drawings. Those skilled in the art will appreciate that the description is only illustrative, exemplary, and should not be construed as limiting the scope of the application.

First of all, it should be noted that the terms top, bottom, upward, downward, etc. mentioned herein are defined with respect to the directions in the respective drawings, they are relative concepts, and thus can be varied in different locations and in different practical states. Therefore, these or other orientation terms should not be construed as limiting terms.

In addition, it should be noted that any single technical feature described or implied in the embodiments herein, or any single technical feature shown or implied in the drawings, can still be combinations between the two to obtain other embodiments of the present application that are not directly mentioned herein.

It should be noted that in the different drawings, the same reference numerals refer to the same or substantially the same assembles.

FIG. 1 is a perspective view of one embodiment of a jump elevator of the present application. Wherein, the elevator 100 according to the present application comprises: a machine room 110 installed within the hoistway 200 and configured to be fixed or movable relative to the hoistway 200; at least one lifting assembly 120 selectively changing the height of the machine room 110 in the hoistway 200.

Wherein, the lifting assembly 120 includes: a frame **120*a* attached to the outside of the hoistway 200 and partially extending into the hoistway 200; a pulley assembly including a winch 130, a fixed end 140, and a plurality of pulley disposed on the machine room 110 and the frame 120*a*, wherein a traction line 150 is disposed between the winch 130, the plurality of pulleys, and the fixed end 140**.

It will be readily appreciated that for the purpose of protecting the building and preventing leakage, a hood or covering portion is often provided within the hoistway 200 to seal the hoistway 200, so as to prevent undesired entry of ambient air and precipitation into the hoistway 200. The lifting assembly 120 according to the present application is provided below the covering portion and can be placed on a finished or unfinished floor. In the illustrated embodiment, the location of the cover is not shown for the sake of clarity. It is easy to understand that the height of the covering portion can be changed as the construction progresses.

In one embodiment, the covering portion may be a slip form. Therefore, by employing the lifting assembly 120 of the present application, the position of the machine room 110 can be adjusted without removing the covering portion, thereby improving the efficiency of adjusting the position of the machine room 110.

In the illustrated embodiment, the machine room 110 is provided with a machine platform 111, a control platform 112, and a work platform 113 in order from bottom to top. The machine room 110 is provided with a plurality of telescopic columns 110*a* sized to fit with the receptacles 210*a* on the inner wall of the hoistway 200. The plurality of columns 110*a* are configured to expand and contract substantially in the horizontal direction, and the accommodation portion 210*a* on the inner wall of the hoistway 200 is configured as notches that extend in a substantially horizontal direction.

As used herein, "horizontal direction" refers to a plane that is generally perpendicular to the vertical direction, that is, the plane in which the floor of the building is normally located. In the illustrated embodiment, the column 110*a* and the receptacle 210*a* are configured to extend substantially in a horizontal direction. However, the column 110*a* may also be disposed at an angle to the horizontal direction according to actual needs. At this time, the receptacle 210*a* is also configured to have a corresponding angle to support the machine room 100 while accommodating the column 110*a*. Similarly, "vertical direction" as used herein refers to the direction in which gravity acts, hoistway 200 generally extends in a vertical direction and jump elevator 100 is designed to carry personnel and material in a vertical direction.

A plurality of sets of receptacles can be disposed within the hoistway 200 in a vertical orientation, so as to support the machine room 110 at different heights and floors.

Further, in the illustrated embodiment, a plurality of columns 110*a* are disposed at the bottom of the machine platform 111. However, the illustrated embodiment is merely illustrative, and a plurality of posts may be disposed at other locations of the machine room 110, such as on the side of the work platform 113 or the control platform 112. In one embodiment, a plurality of posts may also be disposed at the top of the work platform 113.

The plurality of column 110*a* and receptacles 210*a* may be evenly distributed around the perimeter of the machine room 110 or may be arranged with any other suitable spacing. For example, the plurality of columns 110*a* may be disposed at an angle relative to each other, or disposed in parallel with each other, or partially parallel to each other and partially at an angle. As long as these arrangements provide sufficient support for the machine room 110, the present application is intended to cover such variations and modifications.

Moreover, although not shown in the drawings, the elevator 100 according to the present application may further include a car and a counterweight disposed below the machine platform 111.

Although a single lifting assembly 120 is illustrated in the illustrated embodiment, two or more lift assemblies 120 may be employed to adjust the position of the machine room 110 as desired. These lifting assemblies can be arranged to avoid mutual influence.

Figure 2:
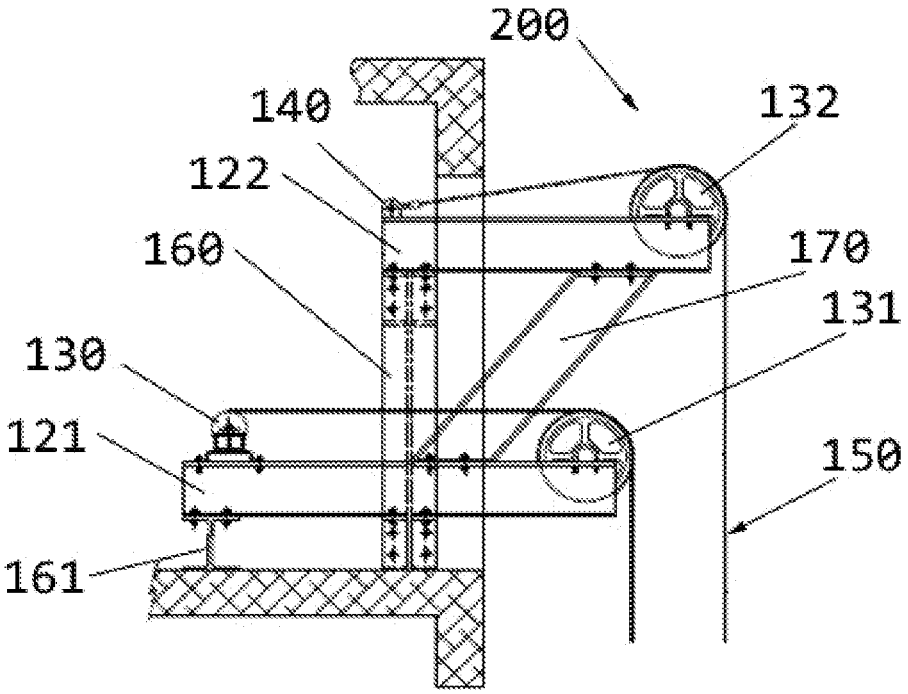
FIG. 2 is a partial enlarged view of the embodiment in FIG. 1.
Figure 3:
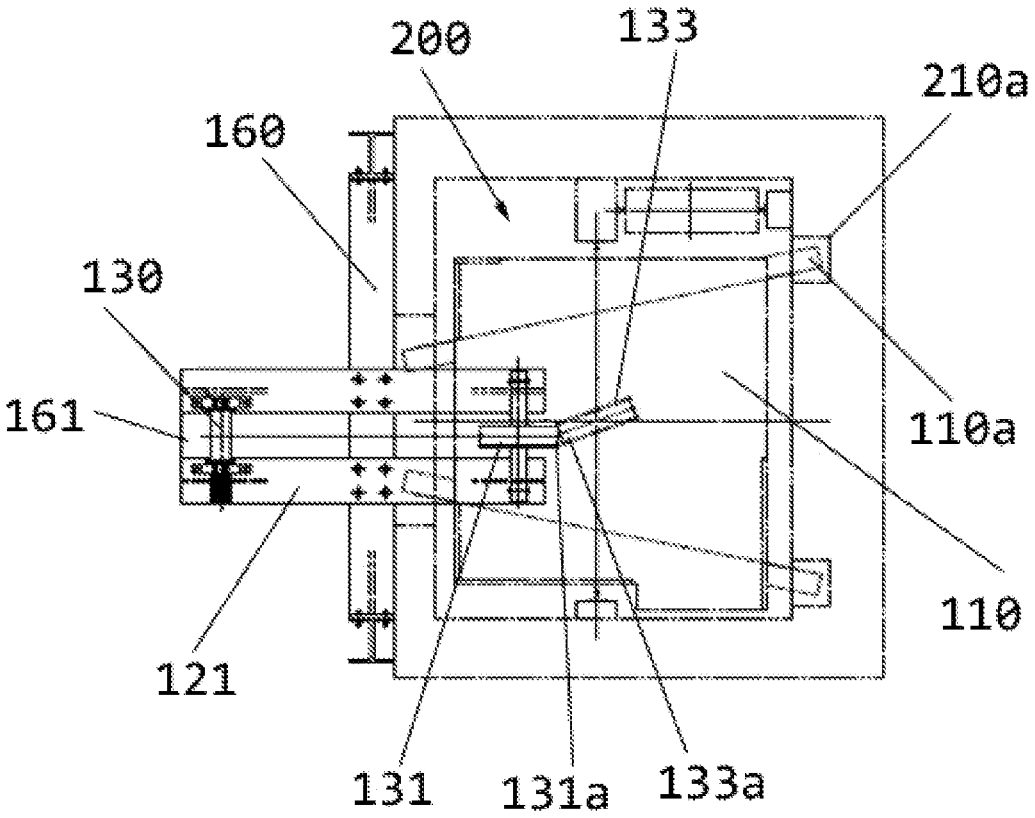
FIG. 3 is a cross-sectional view taken along line A-A in FIG. 1.
Figure 4:
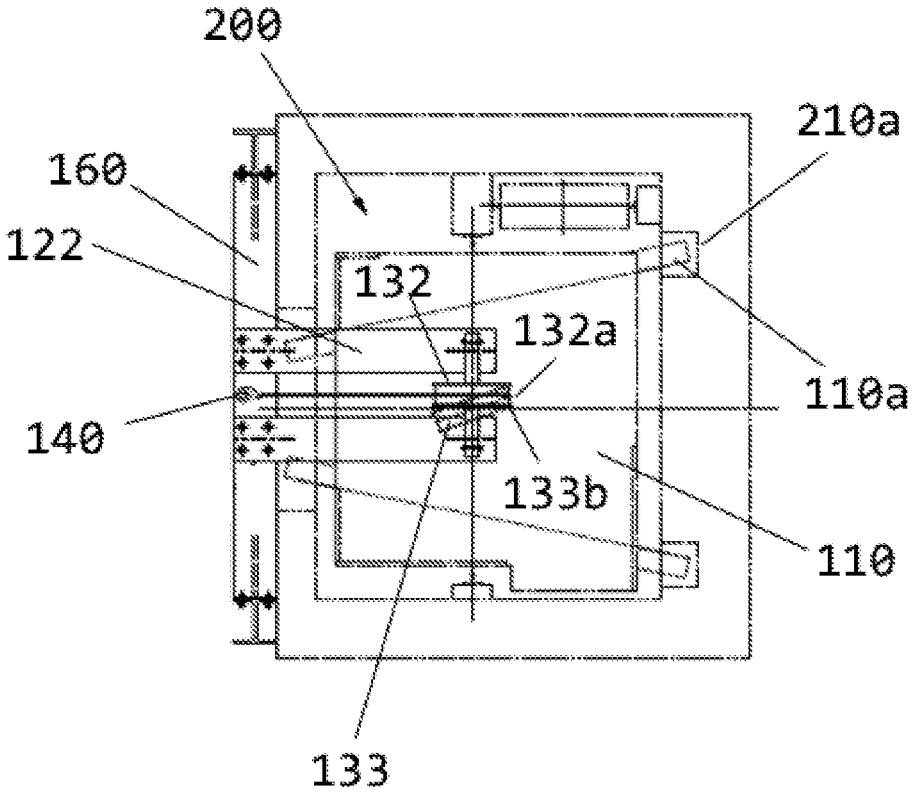
FIG. 4 is a cross-sectional view taken along line B-B in FIG. 1.

FIG. 2 is a partial enlarged view of the embodiment shown in FIG. 1, FIG. 3 is a cross-sectional view taken along line A-A of FIG. 1, and FIG. 4 is a cross-sectional view taken along line B-B of FIG. 1. Wherein, the frame 120*a* includes a first arm 121 and a second arm 122; wherein the first end of the first arm 121 and the first end of the second arm 122 extend into the hoistway 200, and the first pulley 131 and the first pulley 131 are respectively provided on the first end of the first arm 121 and the first end of the second arm 122; and wherein the second end of the first arm 121 and the second end of the second arm 132 extend and are secured outside of the hoistway 200.

Specifically, the first arm 121 and the second arm 122 may be configured to be substantially horizontally arranged, and a first end of the first arm 121 and a first end of the second arm 122 are provided with bearings to support the first pulley 131 And a second pulley 132. The first pulley 131 and the second pulley 132 are thus rotatable relative to the first arm 121 and the second arm 122. Further, as shown in FIG. 1, a third pulley 133 is provided on the top of the machine room 110, and the third pulley 133 is configured to be rotatable relative to the machine room 110. The winch 130 is disposed at the second end of the first arm 121 and the fixed end 140 is disposed at the second end of the second arm 122.

One end of the traction wire 150 is attached to the fixed end 140 and the other end is attached to the winch 130. The traction wire 150 extends through each of the pulleys, to form a movable pulley structure between the first arm 121 and the second arm 122, and the third pulley 133 is formed as a movable pulley so that the machine room 110 can ascend or descend along with the traction wire 150 when the traction wire 150 is pulled.

The winch 130 can be powered by any known source of power, such as an electric motor or an internal combustion engine. The position of the winch 130 may vary depending on actual needs, for example, the position of the winch 130 and the fixed end 140 may be interchanged, or the winch 130 may be disposed at an intermediate position of the first arm 121. The position of the fixed end 140 can also be changed according to actual needs, for example, at an intermediate position of the second arm 122. Additionally, the position of the winch 130 and the fixed end 140 can be set such that when fixed in place, the winch 130 and the fixed end 140 are located outside of the hoistway 200, within the hoistway 200, or on the sidewall of the hoistway 200.

As shown in FIG. 2, the first arm 121 and the second arm 122 are spaced apart by a first distance in a vertical direction, wherein the height of the first arm 121 is lower than the height of the second arm 122. However, other settings may be employed depending on actual needs, such as to make the height of the first arm 121 higher than the height of the second arm 122.

As shown in FIGS. 3 and 4, the first arm 121 and the second arm 122 are spaced apart by a second distance in the horizontal direction such that the pull-out end 131*a* of the first pulley and the pull-out end 132*a* of the second pulley are aligned in the vertical direction with the first end 133*a* and the second end 133*b* of the third pulley 133, respectively. Therefore, in the illustrated embodiment, the first pulley 131 and the second pulley 132 are disposed to be parallel to each other, and the third pulley 133 is disposed to form an angle with the first pulley 131 and the second pulley 132. If different pulley sizes are used, the above positional relationship will change accordingly.

The "pull-out end 131*a* of the first pulley" herein refers to the position of the last contact point between the first pulley 131 and the traction line 150 before the traction line 150 extends vertically downward from the first pulley 131. As shown in FIG. 3, pull-out end 131*a* of the first pulley and the first end 133*a* of the third pulley 133 are positioned adjacent to each other in the vertical direction. Similarly, pull-out end 132*a* of the second pulley and the second end 133*b* of the third pulley 133 are positioned adjacent to each other in the vertical direction.

The position of the third pulley 133 is schematically illustrated in FIGS. 3 and 4 for purposes of clarity. It is easily understood that the third pulley 133 is located below the first pulley 131 and the second pulley 132.

Further, the frame 120*a* further includes a connecting arm 160 to which the first arm 121 and the second arm 122 are attached. In addition, the link arm 160, the first arm 121, and/or the second arm 122 are removably secured in position outside of the hoistway 200 by one or more spacer arms. In the illustrated embodiment, the second end of the first arm 121 is attached to the horizontal plane of the building by a spacer arm 161 and the connecting arm 160 is fixed relative to the sidewall of the hoistway 200. Other suitable connections and fixing methods can also be used according to actual needs.

Additionally, the frame 120*a* can also include a stiffener 170 that is coupled between the first arm 121 and the second arm 122.

By employing the jump elevator of the present application, the hoisting operation of the machine room can be carried out by using a lifting assembly including a winch, thereby simplifying the system required for the elevator. According to actual needs, in a single jump operation, the machine room can move over one or more floors. Therefore, the receptacles can be selectively provided on the side wall of the hoistway according to actual needs, thereby reducing the construction cost.

The application also provides a jumping method comprising the following steps: 1) installing at least one detachable lifting assembly outside the hoistway above a machine room, wherein the lifting assembly is disposed below the covering portion of the hoistway and configured to suspend the machine room; 2) Separating the machine room from the inner wall of the hoistway; 3) activate the lifting assembly to move the machine room to a target position; and 4) Position the machine room in place relative to the inner wall of the hoistway at the target location.

Optionally, the method further includes the following steps: 5) disassembling the lifting assembly.

Optionally, steps 2) through 4) are performed a plurality of times before the step 5) is performed, so as to move the machine room to different target positions and fix it in place.

The above-described jumping method can be performed by the jumping elevator described above or applied to the jumping elevator described above. Accordingly, all of the features, embodiments, and aspects described above can be employed in the construction of the building by applying the above-described jumping method.

It will be readily understood that the target location may be anywhere below the lift assembly and above or below the current location of the machine room. Thus, the jumping method of the present application allows the machine room to pass over one or more floors in a single jump operation and then be fixed in place again.

The machine room has a plurality of telescopic columns that are sized to fit into the receptacles on the inner wall of the hoistway. In one embodiment, a plurality of receptacles may be provided at locations corresponding to each floors of the building. In another embodiment, a plurality of receptacles may be selectively disposed at locations of the hoistway 200 corresponding to some floors of the building, and no receptacles are provided at locations of the hoistway 200 corresponding to other floors of the building.

By employing the jump elevator of the present application, the height of the machine room of the jump elevator can be changed without removing the covering portion of the hoistway. The lifting assembly of the present application can be reused, or can be used to service the jump elevators in multiple buildings in a time-sharing manner, so as to improve the operation efficiency of the elevator and the construction speed of the building.

This application discloses the present application by reference to the drawings, and also to enable those skilled in the art to implement the application, including making and using any device or system, selecting suitable materials, and using any combination. The scope of the present application is defined by the claimed technical solutions and includes other examples that are apparent to those skilled in the art. As long as such other examples include structural elements are not different from the technical language of the claimed technical solution, or such other examples include equivalent structural elements that are not substantially different from the literal language of the claimed technical solution. It should be considered to be within the scope of protection as determined by the technical solution claimed in this application.

What is claimed is:

1. A jump elevator comprising:

a machine room provided in a hoistway and configured to be fixed or movable relative to the hoistway;

at least one lifting assembly comprising:

a frame attached to the outside of the hoistway and partially extending into the hoistway, the frame having at least one arm extending through a wall of the hoistway;

a pulley assembly including a winch, a fixed end of the frame, and a plurality of pulleys disposed on the machine room and the frame; wherein a pulling line is disposed between the winch, the plurality of pulleys, and the fixed end;

wherein the at least one lifting assembly is disposed below a covering portion of the hoistway;

wherein the machine room has a plurality of telescopic columns, the columns being sized to fit with receptacles on the inner wall of the hoistway.

2. The jump elevator of claim 1, wherein the machine room is provided with a machine platform, a control platform and a work platform in order from bottom to top.

3. The jump elevator of claim 2 wherein the plurality of columns are disposed at a bottom of the machine platform.

4. The jump elevator of claim 3, wherein the plurality of columns are configured to expand and contract in a horizontal direction, and accommodation portions on the inner wall of the hoistway are configured to be horizontally extended notch.

5. The jump elevator of claim 2 further comprising a car and counterweight disposed below the machine platform.

6. A jump elevator comprising:

a machine room provided in a hoistway and configured to be fixed or movable relative to the hoistway;

at least one lifting assembly comprising:

a frame attached to the outside of the hoistway and partially extending into the hoistway;

a pulley assembly including a winch, a fixed end of the frame, and a plurality of pulleys disposed on the machine room and the frame; wherein a pulling line is disposed between the winch, the plurality of pulleys, and the fixed end;

wherein the frame includes a first arm and a second arm;

wherein a first end of the first arm and a first end of the second arm extending into the hoistway and respectively mounting a first pulley and a second pulley;

and wherein a second end of the first arm and a second end of the second arm extend and are fixed to the outside of the hoistway;

wherein the winch is disposed at a second end of the first arm and the fixed end is disposed at a second end of the second arm.

7. The jump elevator of claim 6, wherein a third pulley is provided on a top of the machine room, and the third pulley is configured to be rotatable relative to the machine room.

8. The jump elevator of claim 6, wherein the frame further comprises a connecting arm, wherein the first arm and the second arm are attached to the connecting arm.

9. The jump elevator of claim 8, wherein the frame further comprises a stiffener coupled between the second arm and the first arm.

10. A jump elevator comprising:

a machine room provided in a hoistway and configured to be fixed or movable relative to the hoistway;

at least one lifting assembly comprising:

a frame attached to the outside of the hoistway and partially extending into the hoistway;

a pulley assembly including a winch, a fixed end of the frame, and a plurality of pulleys disposed on the machine room and the frame; wherein a pulling line is disposed between the winch, the plurality of pulleys, and the fixed end;

wherein the frame includes a first arm and a second arm;

wherein a first end of the first arm and a first end of the second arm extending into the hoistway and respectively mounting a first pulley and a second pulley;

and wherein a second end of the first arm and a second end of the second arm extend and are fixed to the outside of the hoistway;

wherein the first arm and the second arm are spaced apart by a first distance in a vertical direction, wherein the height of the first arm is lower than the height of the second arm.

11. A jump elevator comprising:

a machine room provided in a hoistway and configured to be fixed or movable relative to the hoistway;

at least one lifting assembly comprising:

a frame attached to the outside of the hoistway and partially extending into the hoistway;

a pulley assembly including a winch, a fixed end of the frame, and a plurality of pulleys disposed on the machine room and the frame; wherein a pulling line is disposed between the winch, the plurality of pulleys, and the fixed end;

wherein the frame includes a first arm and a second arm;

wherein a first end of the first arm and a first end of the second arm extending into the hoistway and respectively mounting a first pulley and a second pulley; and wherein a second end of the first arm and a second end of the second arm extend and are fixed to the outside of the hoistway;

wherein a third pulley is provided on a top of the machine room, and the third pulley is configured to be rotatable relative to the machine room;

wherein the first end of the first arm and the first end of the second arm are spaced apart in a horizontal direction by a second distance, such that a pull-out end of the first pulley and a pull-out end of the second pulley are respectively aligned with the ends of the third pulley in the vertical direction.

12. A jump elevator comprising:

a machine room provided in a hoistway and configured to be fixed or movable relative to the hoistway;

at least one lifting assembly comprising:

a frame attached to the outside of the hoistway and partially extending into the hoistway;

a pulley assembly including a winch, a fixed end of the frame, and a plurality of pulleys disposed on the machine room and the frame; wherein a pulling line is disposed between the winch, the plurality of pulleys, and the fixed end;

wherein the frame includes a first arm and a second arm;

wherein a first end of the first arm and a first end of the second arm extending into the hoistway and respectively mounting a first pulley and a second pulley; and wherein a second end of the first arm and a second end of the second arm extend and are fixed to the outside of the hoistway;

wherein the frame further comprises a connecting arm, wherein the first arm and the second arm are attached to the connecting arm;

wherein the connecting arm, the first arm and/or the second arm are removably fixed in place out of the hoistway by one or more spacer arms.

13. A method of jumping, comprising:

1) installing at least one detachable lifting assembly outside a hoistway above a machine room, wherein the lifting assembly is disposed below a covering portion of the hoistway and configured to suspend the machine room, a frame attached to the outside of the hoistway and partially extending into the hoistway, the frame having at least one arm extending through a wall of the hoistway;

2) separating the machine room from an inner wall of the hoistway;

3) activate the at least one detachable lifting assembly to move the machine room to a target location;

4) positioning the machine room in relative to the inner wall of the hoistway at the target location.

14. The method of claim 13, further comprising:

5) disassembling the at least one detachable lifting assembly.

15. The method of claim 14, wherein the step 2) to the step 4) are performed by a plurality of times before performing the step 5), so as to move the machine room to various different target positions.

16. The method of claim 13, wherein the machine room is provided with a plurality of telescopic columns, the columns being sized to fit into receptacles on an inner wall of the hoistway.

17. The jumping method of claim 16, wherein a receptacle is provided at each floor.

18. The jumping method of claim 17, wherein the receptacle is disposed at some floors, and no receptacle is provided at other floors.

* * * * *